United States Patent [19]

Kubik

[11] 4,087,150

[45] May 2, 1978

[54] QUICK CONNECT WIRING SYSTEM FOR BREADBOARD CIRCUITS

[75] Inventor: Peter Steve Kubik, South Plainfield, N.J.

[73] Assignee: Bell Telephone Laboratories, Incorporated, Murray Hill, N.J.

[21] Appl. No.: 810,402

[22] Filed: Jun. 27, 1977

[51] Int. Cl.[2] ..... H01R 9/08

[52] U.S. Cl. ..... 339/97 P

[58] Field of Search ..... 339/97 R, 97 P, 98, 339/99 R

[56] References Cited

U.S. PATENT DOCUMENTS

| | | | |
|---|---|---|---|
| 2,947,965 | 8/1960 | Scoville | 339/95 |
| 3,621,445 | 11/1971 | Horecky | 339/17 |
| 3,824,527 | 7/1974 | Evans | 339/97 |
| 3,877,771 | 4/1975 | Jensen et al. | 339/99 R |
| 3,963,319 | 6/1976 | Schumacher et al. | 339/99 R |
| 4,040,705 | 8/1977 | Huber | 339/99 R |

*Primary Examiner*—Joseph H. McGlynn
*Attorney, Agent, or Firm*—John W. Fisher

[57] ABSTRACT

A quick connect wiring system for breadboard circuit applications includes a circuit board having a plurality of apertures therethrough. A number of electrically conductive connectors, each comprised of a hollow cylindrical shaft having a pair of insulation penetrating quick connect contacts emanating from one end thereof, are inserted into the apertures in the board. Opposite ends of each of the connectors have integral therewith oppositely directed spring members for engaging integrated circuit package terminals. Insulative members partially surround the connectors to provide conductor support, to improve the electrical isolation among the termination points, and to reduce exposure of the termination points to environmental contamination.

10 Claims, 9 Drawing Figures

QUICK CONNECT WIRING SYSTEM FOR BREADBOARD CIRCUITS

BACKGROUND OF THE INVENTION

1. Field of the Invention

This invention relates to circuit assembly apparatus and, more specifically, to apparatus used to facilitate preparation of breadboard circuits.

2. Description of Prior Art

In the design of almost all circuits, it becomes necessary at some point to fabricate the circuit to ascertain its workability. To facilitate fabrication of experimental circuits, numerous techniques have been devised for simplifying the bread-boarding procedure. One example of apparatus used to facilitate breadboard circuit fabrication is disclosed in R. R. Scoville U.S. Pat. No. 2,947,965, issued Aug. 2, 1960. Scoville discloses a push-in terminal lug having a slot at one end for engaging cross-connection wiring and a pair of slots at an opposite end, one of which has a sawtooth-shaped pattern along its inner edges for engaging lumped element circuit components. While the Scoville apparatus may be suitable for lumped circuit components, such as resistors, capacitors and the like, with the advent of miniaturized integrated circuit packages with their fragile leads, the Scoville-type apparatus is wholly unsatisfactory in fabricating large-scale circuits of the type encountered in computer and communication circuit applications.

Another device developed to assist in breadboard circuit applications is disclosed in W. R. Evans U.S. Pat. No. 3,824,527, issued July 16, 1974. Evans discloses a wire-in-slot electrical connector which comprises a generally V-shaped member having wire-receiving slots extending into corresponding side edges. Plate sections of the "V" are kinked so that, upon insertion of a wire, the plate sections are resiliently stressed by the wire causing them to move toward each other. Similar to Scoville, Evans fails to address the problem of engagement of fragile leads emanating from a dual in-line integrated circuit package.

One example of a connector which has partially taken into account the engagement of fragile integrated circuit leads is disclosed in S. V. Horecky U.S. Pat. No. 3,621,334, issued Nov. 16, 1971. Horecky discloses a connector terminal which has a cylindrical-shaped hollow body with a single leaf spring emanating from one side. Upon insertion of a wire into the hollow cylinder, this leaf spring engages a side portion of the wire and holds it in place in the connector.

A more recent example of the attention directed to solution of the circuit breadboarding problem is evidenced by a copending application Ser. No. 630,183, filed Nov. 10, 1975, in the name of C. A. Von Roesgen, and assigned to the same assignee as the subject application. Von Roesgen relates to a quick connect breadboard system which utilizes an electrical connector having a generally circular terminal at one end for engaging a terminal pin on an integrated circuit package and a single insulation piercing-terminal at an opposite end.

While all of the aforementioned patents and applications have to some extent addressed the problem of facilitating quick connection of breadboard circuits, none of these patents or applications has taken into account the need for frequent changes which may arise and the further need to provide conductor support and electrical isolation at the various termination points. In particular, with respect to wiring changes, none of the referenced inventions, or wirewrapping systems for that matter, provide for ease in effecting such wiring changes.

Accordingly, it is one object of the present invention to facilitate rapid cross-connection of circuit nodes requiring interconnection in breadboard circuits.

Another object is to simplify the procedures needed to effect circuit wiring modifications.

Still another object of the present invention is to permit additional connections to the same connector without degrading the reliability of other connections already made thereon.

A further object is to provide conductor support and electrical isolation at all circuit termination points.

Still a further object of the present invention is to improve the reliability of electrical and mechanical connections with terminal pins on integrated circuit packages in breadboard wiring systems.

Yet another object is to shield termination points in breadboard circuits from environmental contaminants.

SUMMARY OF THE INVENTION

The foregoing and other objects of the invention are realized in an illustrative embodiment of apparatus for mounting electrical circuit components and for facilitating interconnection of the components by insulation-covered conductors. This apparatus includes an insulative board which has a planar array of apertures extending therethrough. Mounted in the array of apertures is a plurality of electrically conductive connectors. Each of these connectors has facility at one end for accepting a terminal pin of an electrical circuit component. Internal to the accepting apparatus are oppositely directed spring members for holding the terminal pin in electrical and mechanical contact with the connector. At an opposite end of the connector are first and second insulation penetrating slotted beam contacts which are spaced apart and laterally offset from one another. Insulative members placed intermediate the insulation penetrating contacts and along at least an outer edge of one of these contacts provide support for, and electrical isolation among, the insulation-covered conductors at their termination points.

Accordingly, it is one feature of the present invention that cross-connections among circuit components can be easily and rapidly effected without prior wire preparation.

Another feature is that multiple connections can be advantageously made to the same terminal without degrading circuit reliability.

A further feature of the present invention is improved electrical and mechanical contact with terminal pins on integrated circuit packages.

Still another feature is improved electrical isolation among the termination points.

Yet a further feature of the present invention is that wiring changes are easily and rapidly effected without disrupting desired terminations.

An even further feature is that the breadboard wiring system permits a lower profile to be obtained in a completed circuit than that heretofore possible.

BRIEF DESCRIPTION OF THE DRAWINGS

The aforementioned objects and features of the invention, as well as other objects and features, will be better understood upon consideration of the following detailed description and the appended claims taken in conjunction with the attached drawings of an illustrative embodiment in which:

DETAILED DESCRIPTION

Figure 1:
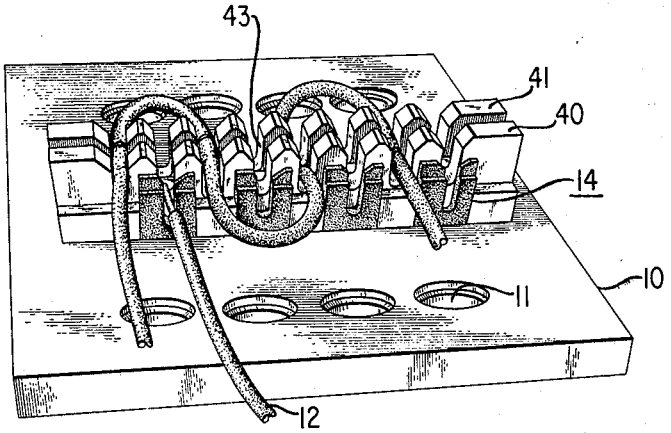
FIG. 1 illustrates a quick connect wiring system for breadboard circuits showing a number of typical wire cross-connections.
Figure 2:
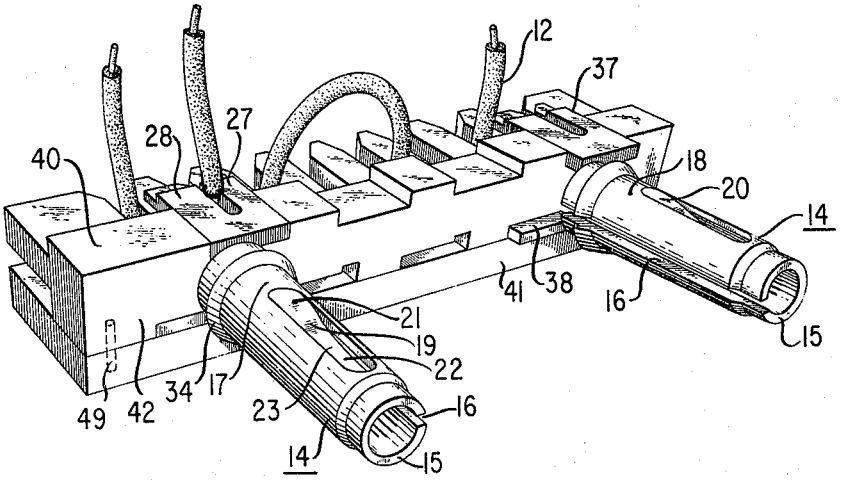
FIG. 2 illustrates the apparatus for providing improved electrical isolation among the wire termination points.

Apparatus for mounting electrical circuit components (not shown) and for facilitating interconnection of such components is illustrated in FIG. 1. An insulative board 10 has a plurality of apertures 11 therethrough arranged in a planar array. Electrically conductive connectors 14, shown more clearly in FIGS. 5 through 8, are inserted into each of apertures 11 in the array. First and second insulative members 40 and 41, as shown in FIG. 2, nearly surround slotted beam insulation penetrating contacts 37 and 38 on each of connectors 14 to improve the electrical isolation of the termination points from one another and further to provide support for insulation-covered conductors 12 used to effect cross-connections among the various circuit components.

Each of connectors 14, as shown in FIGS. 5 through 8, is comprised of a hollow cylindrical shaft 15. An outer diameter of shaft 15 is slightly larger than a diameter of aperture 11. Elongated slot 16 extends along the length of shaft 15. Slot 16, in conjunction with the slightly larger outer diameter of shaft 15, enables shaft 15 to resiliently engage aperture 11.

At one end of shaft 15 there is provision for accepting a terminal pin of an integrated circuit package. This accepting provision is effected by sidewall portions 17 and 18 of shaft 15 which have oppositely directed cantilevered spring clips 19 and 20 therein. Each of spring clips 19 and 20 has one end 21 integral with one of sidewall portions 17 and 18, respectively. Intermediate free end 22 and integral end 21 of each of spring clips 19 and 20 is an inwardly directed bowed portion 23. Spring clips 19 and 20, as described, hold terminal pins on the integrated circuit package in mechanical and electrical contact with connector 14.

At an opposite end of connector 14 there is a pair of slotted beam contacts 37 and 38 for effecting insulation penetrating wire connections with conductors 12. Each of contacts 37 and 38 is comprised of an end portion 25 which is integral with shaft edge 26. Slotted beam contacts 37 and 38 are spaced apart and laterally offset from one another and lie in first and second parallel planes perpendicular to a plane containing insulative board 10. Integral with and extending outwardly from end portion 25 are cantilevered beams 27 and 28. Beams 27 and 28 are spaced apart from one another by a distance slightly less than a diameter of conductor 12. Moreover, end portion 25 and cantilevered beams 27 and 28 have a generally uniform thickness approximately equal to a wall thickness of shaft 15.

By virtue of slotted beam contacts 37 and 38, cross-connection wiring among various terminal pins on integrated circuit packages may be easily effected without need for advance preparation of the cross-connection wires. Utilization of a pair of slotted beam contacts 37 and 38 in connector 14 permits multiple connections to be effected. The spacing between slotted beam contacts 37 and 38 and their lateral displacement from one another improves the electrical isolation among the various termination points. Moreover, oppositely directed spring clips 19 and 20 increase the reliability of the electrical and mechanical connection of connector 14 with terminal pins on integrated circuit packages. It should be evident that in fabricating breadboard circuits utilizing integrated circuit packages in accordance with the subject breadboard wiring system, the integrated circuit packages may be advantageously easily installed or relocated should this be necessary or desirable.

Near tip regions 29 and 30 there is formed a funnel-shaped wire entryway 33. Oppositely directed edge faces 31 and 32, forming wire entryway 33, have a thickness somewhat less than the thickness of beams 27 and 28 in order to facilitate penetration of the insulation covering conductors 12.

At an intermediate point along the length of shaft 15 there is a generally triangular-shaped projecting lip 34. Projecting lip 34 extends circumferentially around an outer sidewall of shaft 15 and is spaced apart from end portions 25 of slotted beam contacts 37 and 38 by a distance approximately equal to a thickness of insulative board 10. Along a top surface of lip 34 is a shoulder 35. Shoulder 35 engages an underside of insulative board 10 about a periphery of aperture 11 upon insertion of connector 14 into board 10 to securely hold connector 14 in engagement with board 10.

Figure 3:
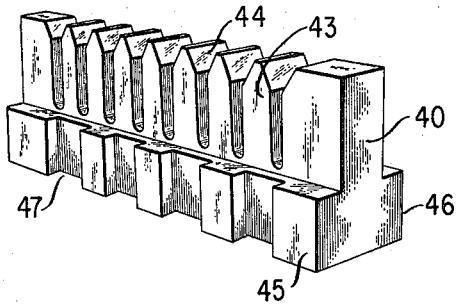
FIG. 3 illustrates one insulative member.
Figure 4:
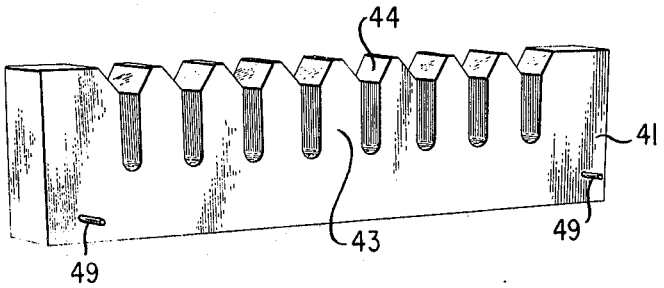
FIG. 4 illustrates a second insulative member for providing improved electrical isolation along an outer edge of a connector component.
Figure 5:
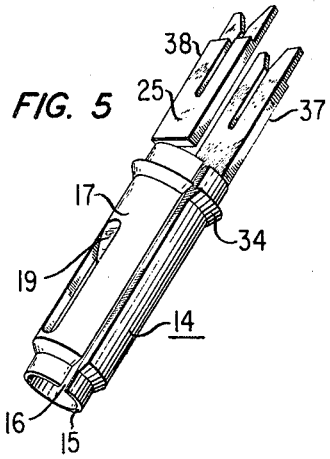
FIGS. 5 through 8 are perspective views of a connector component illustrating slotted beam contacts and oppositely directed spring members for mechanically and electrically securing terminal pins on integrated circuit packages to the connector.
Figure 6:
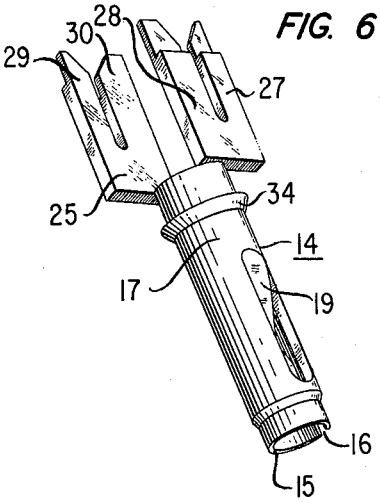
Figure 7:
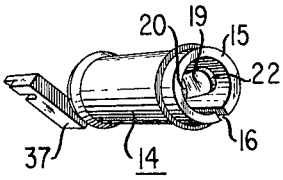
Figure 8:
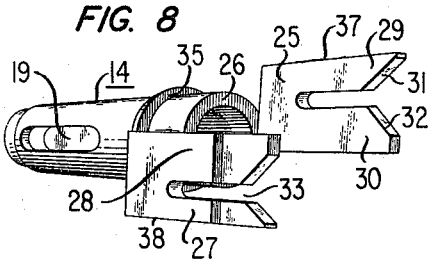
Figure 9:
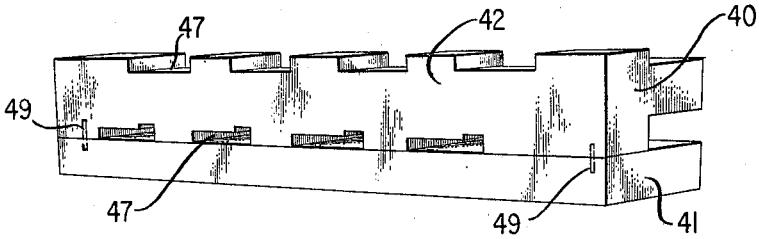
FIG. 9 illustrates the mechanical connection for securing the first and second insulative members to one another.

Insulative members 40 and 41, shown individually in FIGS. 3 and 4, respectively, and in a mated relationship in FIG. 9, are employed to further improve the electrical isolation among termination points, and to provide support for conductors 14. Member 41 includes a base portion 42 which has integral therewith and extending upwardly therefrom a plurality of spaced-apart teeth 43. Teeth 43 extend slightly beyond slotted beam contacts 37 and 38. To facilitate the routing of conductors 12 into engagement with slotted beam contacts 37 and 38, spaced-apart teeth 43 include tapered tip regions 44 which form generally V-shaped wire entryways.

Along first sidewall 45 of member 40 there is a plurality of notches 47. The spacing between notches 47 corresponds to the lateral spacing between apertures 11 in board 10. On second sidewall 46 of insulative member 40 is a similar plurality of notches 47. It should be noted that notches 47 in first sidewall 45 are laterally displaced from corresponding notches 47 in second sidewall 46. This lateral displacement between the two sets of notches 47 corresponds to the lateral offset between slotted beam contacts 37 and 38. In addition, the two sets of notches 47 are transversely separated from one another by the thickness of base portion 42 which is nearly equal to the transverse separation distance between slotted beam contacts 37 and 38.

Insulative member 41 is somewhat similar in construction to insulative member 40. In particular, insulative member 41 includes base portion 42 which has integral therewith and extending upwardly therefrom a plurality of spaced-apart teeth 43 which terminate in tapered tip regions 44. The function of tapered tip regions 44 and spaced-apart teeth 43 is identical to that provided by corresponding members in insulative member 40.

It should be evident from FIG. 2 that insulative members 40 and 41 are located intermediate slotted beam contacts 37 and 38 with insulative member 41 extending lengthwise along an outer edge face of slotted beam contacts 37, for example. Provision of insulative member 41 along an outer edge face of slotted beam contacts 37 serves to improve the electrical isolation among the various termination points of conductors 12 and further supports conductors 12 to hold them in a spaced-apart relationship. Insulative members 40 and 41 are held juxtaposed one another on insulative board 10 by resilient coupling pin 49, shown in FIG. 4.

In summary, a quick-connect wiring system for breadboard circuits has been described wherein experimental circuits can be rapidly and easily fabricated without the use of special tools or the need for prior preparation of the interconnection wires. Moreover, multiple connections can be advantageously effected with each of connectors 14 to facilitate multiple cross-connections. Finally, inclusion of a pair of oppositely directed spring clips 19 and 20, integral with connector 14, improves the electrical and mechanical reliability of connections with terminal pins on integrated circuit packages.

In all cases, it is to be understood that the above-described embodiment is illustrative of but a small number of many possible specific embodiments which can represent applications of the principles of the invention. Thus, numerous and various other embodiments can be devised readily in accordance with these principles by those skilled in the art without departing from the spirit and scope of the invention.

What is claimed is:

1. Apparatus for mounting electrical circuit components and for facilitating interconnection of said components by insulation-covered conductors comprising:

an insulative board having a planar array of apertures therethrough;

a plurality of electrically conductive connectors, at least one of said connectors engaging at least one of said apertures, each of said connectors including, means at one end for accepting a terminal pin of one of said electrical circuit components, oppositely directed spring means internal to said accepting means for holding said terminal pin in electrical and mechanical contact with said connector, and first and second means at an opposite end of said connector for effecting insulation penetrating wire connections with said insulation-covered conductors, said first and second means being spaced apart and laterally offset from one another; and insulative means intermediate said first and second effecting means and along at least an outer edge of one of said first and second effecting means, said insulative means extending outwardly from said board to a point beyond said first and second effecting means for improving the electrical isolation among termination points of said conductors and further supporting said conductors in a spaced-apart relationship.

2. The apparatus in accordance with claim 1 wherein said insulative means comprises:

first and second members, each including a base portion, and a plurality of spaced-apart teeth integral with and extending upwardly from said base portion, said spaced-apart teeth having tapered tip regions to facilitate engagement with said insulation-covered conductors;

said first member further including a first sidewall having a plurality of spaced-apart notches therein, and a second sidewall having a corresponding plurality of spaced-apart notches therein, said notches in said first sidewall being laterally displaced from said notches in said second sidewall so as to be in alignment with said first and second effecting means, said first and second sidewall notches further being transversely separated from one another by a base portion thickness approximately equal to a transverse separation distance between said first and second effecting means; and means for resiliently coupling said first and second members to one another.

3. The apparatus in accordance with claim 1 wherein said accepting means comprises a hollow cylindrical shaft, having an outer diameter slightly larger than a diameter of an aperture in said insulative board and having an elongated slot running the length thereof, for enabling said shaft to resiliently engage said aperture.

4. The apparatus in accordance with claim 3 wherein said oppositely directed spring means comprises:

first and second sidewall portions of said cylindrical shaft, said sidewall portions each having therein one end integral with said shaft and a free end with an inwardly directed bowed portion intermediate said integral end and said free end.

5. The apparatus in accordance with claim 3 wherein each of said first and second effecting means comprises:

an end portion integral with said shaft along a portion of an edge;

first and second cantilevered beams integral with and extending outwardly from said end portion, said beams being spaced apart from one another by a distance slightly less than a conductor diameter, said end portion and said first and second beams having a generally uniform thickness approximately equal to a wall thickness of said hollow cylindrical shaft; and first and second tip regions at ends of each of said beams having oppositely directed edge faces forming a generally funnel-shaped wire entryway, said tip regions having a thickness somewhat less than said thickness of said beams to facilitate penetration of said insulation covering said conductors.

6. The apparatus in accordance with claim 5 wherein said hollow cylindrical shaft includes a generally triangular-shaped projecting lip extending circumferentially around an outer sidewall of said shaft, said lip being spaced apart from each end portion by a distance approximately equal to a thickness of said insulative board, said lip having a shoulder for engaging an underside of said insulative board about an aperture periphery upon insertion of said connector into said board.

7. Apparatus for mounting electrical circuit components and for facilitating interconnection of said components by insulation-covered conductors comprising:

an insulative board having a planar array of apertures therethrough;

a plurality of electrically conductive connectors, at least one of said connectors engaging at least one of said apertures, each of said connectors including a hollow cylindrical shaft, having an outer diameter slightly larger than a diameter of an aperture in said insulative board and having an elongated slot running the length thereof, for enabling said shaft to resiliently engage said aperture, oppositely directed spring means for holding terminal pins of said component in electrical and mechanical contact with said connector, said spring means being integral with first and second sidewall portions of said cylindrical shaft, each of said spring means having one end integral with said shaft and a free end with an inwardly directed bowed portion intermediate said integral end and said free end, and first and second means at an opposite end of said connector for effecting insulation penetrating wire connections with said insulation-covered conductors, said first and second effecting means being spaced apart and laterally offset from one another to permit multiple connections to be made to said connector for improving the electrical isolation among termination points;

first and second insulative members, one of said members intermediate said first and second effecting means and the other of said members along an outer edge of one of said first and second effecting means each of said insulative members including a base portion and a plurality of spaced-apart teeth integral with and extending upwardly from said base portion, said spaced-apart teeth having tapered tip regions to facilitate engagement with said insulation-covered conductors; and means for resiliently coupling said first and second insulative members to one another.

8. The apparatus in accordance with claim 7 wherein said first insulative member further includes a first sidewall having a plurality of spaced-apart notches therein; and a second sidewall having a corresponding plurality of spaced-apart notches therein, said notches in said first sidewall being laterally displaced from said notches in said second sidewall so as to be in alignment with said first and second effecting means, said first and second sidewall notches further being transversely separated from one another by a base portion thickness approximately equal to a transverse separation distance between said first and second effecting means.

9. The apparatus in accordance with claim 7 wherein each of said first and second effecting means comprises:

an end portion integral with said shaft along a portion of an edge;

first and second cantilevered beams integral with and extending outwardly from said end portion, said beams being spaced apart from one another by a distance slightly less than a conductor diameter, said end portion and said first and second beams having a generally uniform thickness approximately equal to a wall thickness of said hollow cylindrical shaft; and first and second tip regions at ends of each of said beams having oppositely directed edge faces forming a generally funnel-shaped wire entryway, said tip regions having a thickness somewhat less than said thickness of said beams to facilitate penetration of said insulation covering said conductors.

10. The apparatus in accordance with claim 9 wherein said hollow cylindrical shaft includes a generally triangular-shaped projecting lip extending circumferentially around an outer sidewall of said shaft, said lip being spaced apart from each end portion by a distance approximately equal to a thickness of said insulative board, said lip having a shoulder for engaging an underside of said insulative board about an aperture periphery upon insertion of said connector into said board.

* * * * *